United States Patent [19]

Chambre

[11] Patent Number: 4,967,641

[45] Date of Patent: Nov. 6, 1990

[54] DEVICE TO ASSIST AN OPERATOR WITH TARGET ACQUISITION IN A WEAPONS SYSTEM

[75] Inventor: Jacques Chambre, Villemomble, France

[73] Assignee: Thomson CSF, Paris, France

[21] Appl. No.: 426,523

[22] Filed: Oct. 24, 1989

Related U.S. Application Data

[63] Continuation of Ser. No. 107,247, Oct. 9, 1987, abandoned.

[30] Foreign Application Priority Data

Oct. 14, 1986 [FR] France ..... 84 14258

[51] Int. Cl.[5] ..... F41G 3/00

[52] U.S. Cl. ..... 89/41.08; 455/54; 367/116

[58] Field of Search ..... 89/41.05, 41.07, 41.08, 89/41.21, 41.22, 1.8, 1.813, 1.814, 1.816; 2/6; 381/183; 342/451, 455, 32; 367/116; 455/54, 69, 55

[56] References Cited

U.S. PATENT DOCUMENTS

| | | | |
|---|---|---|---|
| 2,069,208 | 2/1937 | Batchelder | 367/123 |
| 2,425,614 | 8/1947 | Goddard | 455/69 |
| 3,209,260 | 9/1965 | Young | 455/54 |
| 3,614,723 | 10/1971 | Hermes | 89/41.08 |
| 3,824,699 | 7/1974 | Lenz | 89/41.11 |
| 3,887,896 | 6/1975 | Ramstedt | 367/900 |
| 3,940,769 | 2/1976 | Sherman et al. | 342/427 |
| 3,971,019 | 7/1976 | Rymes | 342/422 |
| 3,987,403 | 10/1976 | Smith | 342/24 |
| 4,030,065 | 6/1977 | Bateman | 342/455 |
| 4,173,008 | 10/1979 | Keith et al. | 367/124 |
| 4,360,876 | 11/1982 | Girault et al. | 342/451 |
| 4,584,707 | 4/1986 | Goldberg et al. | 455/54 |
| 4,682,368 | 7/1987 | Takahashi | 455/54 |
| 4,692,763 | 9/1987 | Gregg | 342/24 |
| 4,713,669 | 12/1987 | Shuch | 342/455 |

FOREIGN PATENT DOCUMENTS

| | | | |
|---|---|---|---|
| 0603630 | 8/1960 | Canada | 342/455 |
| 0092600 | 11/1983 | European Pat. Off. . | |
| 2436169 | 2/1976 | Fed. Rep. of Germany . | |
| 2078693 | 11/1971 | France . | |
| 507587 | 6/1939 | United Kingdom . | |
| 1235253 | 6/1971 | United Kingdom | 342/455 |

OTHER PUBLICATIONS

Mailing, Aural Monitoring of Waveforms, 4/69, p. 1469.

European Patent Office Search Report, Jul. 31, 1987.

*Primary Examiner*—Charles T. Jordan
*Assistant Examiner*—Stephen Johnson
*Attorney, Agent, or Firm*—Marmorek, Guttmann & Rubenstein

[57] ABSTRACT

A device assists in target acquisition by an operator in a weapon system comprising a target detection and locating system that delivers target-locating data, said device comprising means to synthesize stereophonic signals intended for the operator and means to convert target-locating data into data controlling the synthesis of stereophonic signals so that the operator is given a subjective sensation of a direction of attack corresponding to the actual direction of the target with respect to this operator.

9 Claims, 2 Drawing Sheets

DEVICE TO ASSIST AN OPERATOR WITH TARGET ACQUISITION IN A WEAPONS SYSTEM

This is a continuation of application Ser. No. 107,247, filed Oct. 9, 1987 now abandoned.

BACKGROUND OF THE INVENTION

1. Field of the Invention

The present invention pertains to a device to assist an operator with target acquisition in a weapons system.

A weapons system comprises, in a known way, a unit for the detection and locating of targets, such as a radar, and firing units capable of firing in the direction of the targets thus located.

The present invention pertains more especially to a short-range weapons system in which the firing operations are performed manually by an operator. This implies that, before any firing operation, the operator acquires the target in his sighting device and is therefore led to look in the direction of the target. It may be assumed that the operator's own means of perception are sufficient for this action but, in fact, a procedure of this kind would be ineffective, especially in the face of fast-moving low-altitude targets which reveal themselves very belatedly (because of natural obstacles such as hills and trees, for example).

2. Description of the Prior Art

A more efficient method consists in transmitting data from the detection and locating system, which moreover acquires the target, to the operator, to inform him of the nature of the target, where it comes from and its approaching speed so that his reaction can be anticipated. But the problem then lies in the choice of the communications interface between the detection/locating system and the operator. At present, this takes the form of an alert, generally given by phonic methods. However, this method is cumbersome for the operator who often has very little time to react, given the speed of certain targets and the time taken to use the method.

SUMMARY OF THE INVENTION

An object of the present invention is another warning method which is less cumbersome for the operator from the physiological point of view and, at the same time, operationally more efficient.

The invention pertains to a device to provide an operator with target acquisition assistance in a weapon system comprising a target detection and locating system that delivers target-locating data, said device comprising means to synthesize stereophonic sound signals intended for the operator and means to convert target-locating data into control data for the synthesis of stereophonic signals so that the operator gets a subjective sensation of a direction of attack corresponding to the actual direction of the target with respect to said operator.

BRIEF DESCRIPTION OF THE DRAWINGS

Other objects and features of the present invention will emerge more clearly from the following description of an embodiment, made with reference to the appended drawings, of which.

DESCRIPTION OF THE PREFERRED EMBODIMENT

Figure 3:
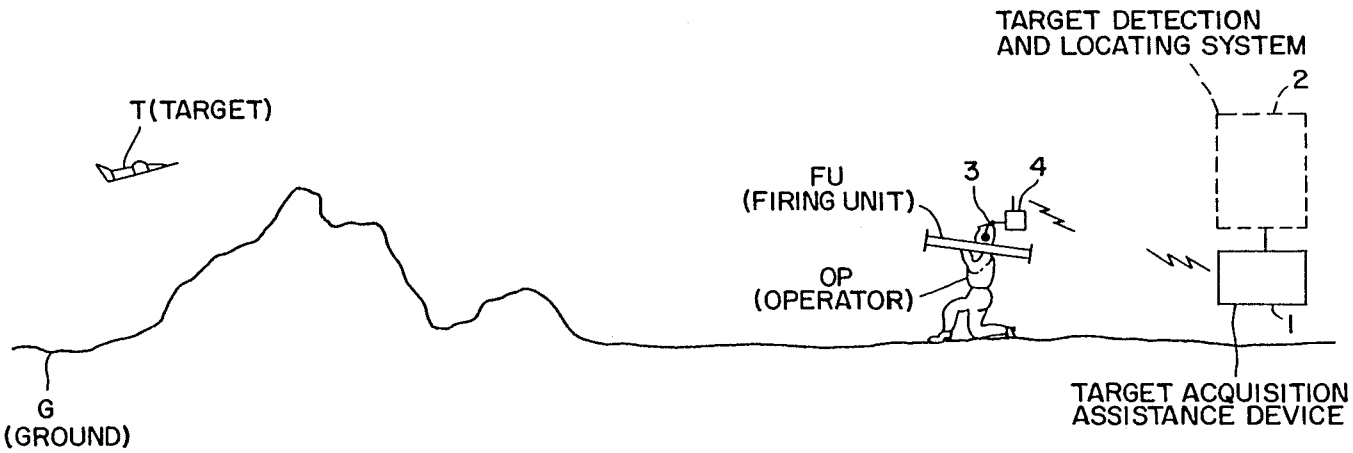
FIG. 3 schematically illustrates a target and a weapons system.

In FIG. 3 are shown a target T and a weapon system operated by an operator OP and comprising a firing unit FU, a target detection and locating system 2 and a target acquisition assistance device 1, including a stereophonic helmet 3 and a helmet processor 4, for assisting the operator of the firing unit. The system 2 delivers target-locating data to the device 1.

The device 1 for providing an operator in a weapons system with assistance in target acquisition sets up an interface between the detection and locating system 2 of the weapons system and n operators wearing stereophonic helmets such as $3_n$ (for greater clarity, only one of them has been shown). This device comprises a processor $4_n$, called a helmet processor, associated with each of the n helmets $3_n$. Said processor is capable of synthesizing stereophonic signals upon activation by signals received from a computer 5 with which said processor communicates.

This computer 5 itself receives the following data from the detection and locating system 2 for each target detected by the system (it is assumed that there are several targets): the nature (N), direction ($D_1$), distance (d) and approaching speed (V) of the target.

Using this data, called target-locating data, the computer 5 prepares control data for the synthesis of stereophonic sound signals which are retransmitted to the ear-pieces of the helmets worn by the n operators, giving them the subjective sensation of a direction of attack which corresponds to the actual direction in which the targets assigned to them are located.

For this purpose, the data on direction is converted by the computer 5 into phase data (u), the data on distance into intensity data (I) and the data on speed (V) into frequency data (f).

Before being converted into phase data, the data ($D_1$) on the direction of the target is combined with the data ($D_2$) on the direction in which the operator is looking, so as to obtain the stereophonic direction of the target with respect to the operator, given the tilt of his head.

This data on the direction ($D_2$) in which the operator is looking can also be delivered by a gyrometrical sensor, but also, in view of the relative precision required, by a magnetic system adjusted to the local magnetic dip: it is then transmitted from the helmet processor 4 to the computer 5. When it has been elaborated by the computer 5, the data controlling the synthesis of the stereophonic signals is stored in n registers $6_n$ for multiplexed transmission to the n processors $4_n$.

Figure 1:
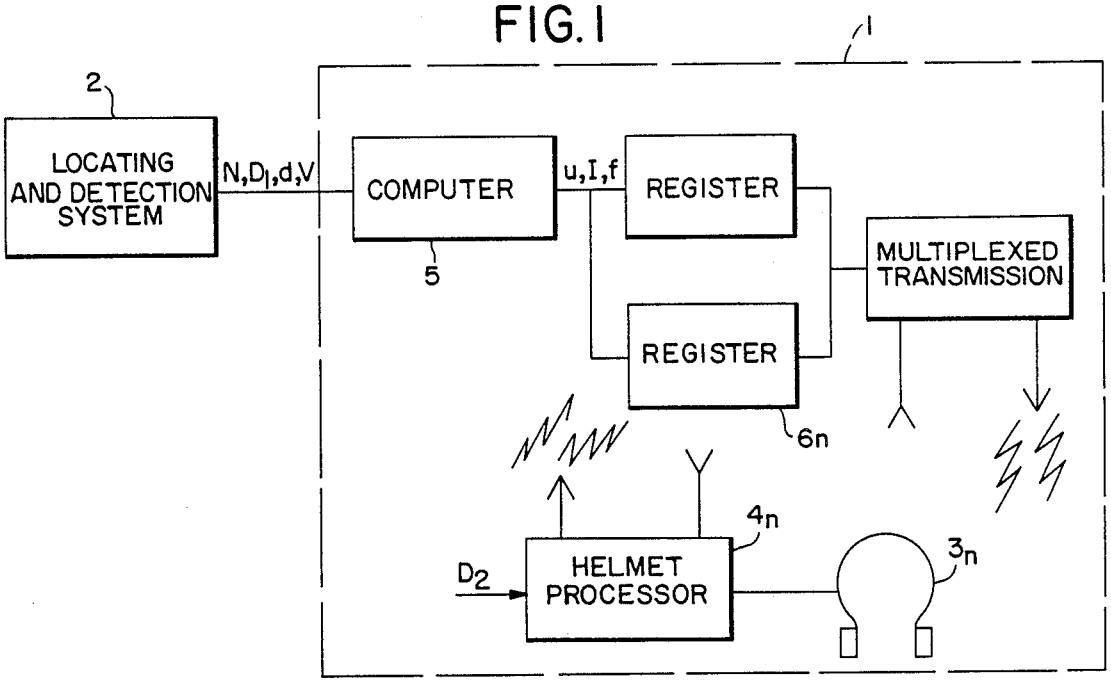
FIG. 1 is a schematic drawing of a device for assistance in target acquisition according to the invention.
Figure 2:
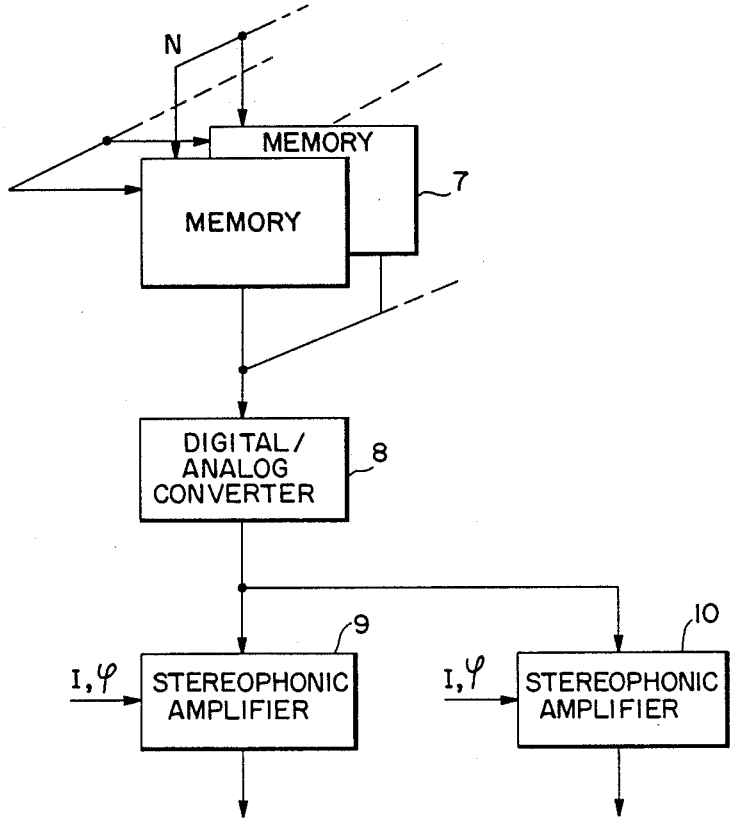
FIG. 2 is a block diagram of a stereophonic signals synthesizer used in a device for assistance in target acquisition according to the invention.

As shown in FIG. 2, each helmet processor contains the binary signals corresponding to the different natures of targets, said binary signals being stored in the read-only memory 7.

The appropriate memory, selected on the basis of the data (N) on the nature of the target, is read at a rate corresponding to the frequency elaborated by the computer 5, and the signal obtained, after digital/analog conversion in a converter 8, is applied to the input of two stereophonic amplifiers 9 and 10, which give the gains and phase-shifts corresponding to the data on intensity and phase transmitted by the computer 5. The operator thus hears a sound signal which gives him a subjective impression of the direction and nearness of the target and informs him of its nature.

The data for controlling the synthesis of the stereophonic signals is up-dated by the computer 5 according to the movements of the operator's head and the extrapolated movement of the target. The subjective direction of the noise thus always corresponds to the actual direction of said target.

The operator can thus turn very quickly towards the target assigned to him and acquire it.

What is claimed is:

1. A device to provide an operator with target acquisition assistance in a weapon system comprising a target detection and locating system that delivers target-locating data, said device comprising means to synthesize stereophonic sound signals intended for the operator, and means to convert said target-locating data into control data for a synthesis of stereophonic signals so that the operator gets a subjective sensation of a direction of attack corresponding to an actual direction of a target with respect to said operator, wherein the target-locating data comprise direction data indicating the actual direction of said target and wherein said direction data is combined, after conversion, with data indicating a direction in which the operator is looking.

2. A device to provide an operator with target acquisition assistance in a weapon system comprising a target detection and locating system that delivers target-locating data, said device comprising means to synthesize stereophonic sound signals intended for the operator, and means to convert said target locating data into control data for a synthesis of stereophonic signals so that the operator gets a subjective sensation of a direction of attack corresponding to an actual direction of a target with respect to said operator, wherein said means for synthesizing stereophonic sound signals comprises a read only memory containing binary signals that correspond to a given target, an output of said memory being applied to a digital/analog converter which has its own output applied to two stereophonic amplifiers.

3. A device according to claim 2 wherein different types of binary signals are stored in said read only memory, said binary signals corresponding to different types of targets.

4. A weapon system comprising a target detection and locating system for delivering target locating data including at least an actual direction, a distance and an approach speed for a target, synthesizing means for synthesizing sound signals intended for an operator of the weapon system; and converting means for receiving said target locating data from said target detection and locating system and for converting said target locating data into control data for said synthesizing means so that said synthesizing means synthesizes sound such that said operator gets a subjective sensation of a direction of attack corresponding to said actual direction of said target with respect to said operator.

5. A system according to claim 4 wherein said direction data is combined, after conversion by said converting means, with data indicating a direction in which the operator is looking.

6. A system according to claim 4 wherein said converting means comprises a computer that converts said target-locating data on direction, distance and approaching speed into phase, intensity and frequency data, respectively.

7. A system according to claim 4 wherein said means for synthesizing stereophonic sound signals comprises a read-only memory having an output and addressing inputs and containing binary signals that correspond to a given target, a digital to analog converter having an input receiving said output of said memory and an output and two stereophonic amplifiers connected to said output of said converter.

8. A system according to claim 7, wherein said target-locating data comprise in addition data concerning characteristics of said target, wherein said read-only memory contains binary signals corresponding to different types of targets and wherein said data concerning the characteristics of said target are applied to said addressing inputs of said memory for selecting said binary signals corresponding to said target.

9. A weapon system comprising a target detection and locating system for delivering target locating data including at least an actual direction, a distance and an approach speed for a target, converting means for receiving said target locating data and for converting the target locating data into control data, and sound synthesizing means for receiving said control data and for synthesizing stereophonic sound signals intended for an operator of said weapon system in response to said control data, said stereophonic sound signals providing the operator with a subjective sensation of a direction of attack corresponding to said actual direction of said target with respect to said operator.

* * * * *